US006715919B2

(12) United States Patent
Hiraiwa et al.

(10) Patent No.: US 6,715,919 B2
(45) Date of Patent: Apr. 6, 2004

(54) PAPER BAG WITH FILM INNER BAG

(75) Inventors: Kenichi Hiraiwa, Ageo (JP); Yoichi Numata, Kanagawa (JP)

(73) Assignee: Showa Paxxs Corporation (JP)

( * ) Notice: Subject to any disclaimer, the term of this patent is extended or adjusted under 35 U.S.C. 154(b) by 0 days.

(21) Appl. No.: 10/197,380

(22) Filed: Jul. 17, 2002

(65) Prior Publication Data

US 2003/0035598 A1 Feb. 20, 2003

(30) Foreign Application Priority Data

Aug. 16, 2001 (JP) ..... 2001-247029

(51) Int. Cl.[7] ..... B65D 33/00

(52) U.S. Cl. ..... 383/205; 383/116; 383/120; 383/123; 383/201

(58) Field of Search ..... 383/201, 120, 383/205, 89, 111, 116, 209, 123

(56) References Cited

U.S. PATENT DOCUMENTS 3,038,651 A * 6/1962 Cloudsley ..... 383/208
3,458,111 A * 7/1969 Leasure et al. ..... 383/201
3,482,758 A * 12/1969 La Pierre et al. ..... 229/117.27
3,663,239 A * 5/1972 Rowe et al. ..... 426/113
3,807,626 A * 4/1974 Goodrich ..... 383/85
3,958,749 A * 5/1976 Goodrich ..... 383/206
5,529,396 A * 6/1996 Pryor et al. ..... 383/111
5,613,779 A * 3/1997 Niwa ..... 383/201
6,312,742 B1 * 11/2001 Wood et al. ..... 426/122

FOREIGN PATENT DOCUMENTS

JP 2000-202956 7/2000
JP 2000-289151 10/2000

* cited by examiner

*Primary Examiner*—Jes F. Pascua
(74) *Attorney, Agent, or Firm*—Greer, Burns & Crain, Ltd.

(57) ABSTRACT

A paper bag with a film inner bag in which the inner bag element is constructed so that its closed end portions can be torn in the lateral direction, thus allowing easy opening by hand across the entire width of the bag or across a part of this width. The inner bag element consists of a synthetic resin film and has cut portions formed along the longitudinal direction in the end portions of the bag that are closed by heat-sealing and that are planned to be opened in the future. The end portion constituting the bottom part is closed by heat-sealing, or by being folded together with the outer bag element or stitched with a sewing machine. The outer bag element, which consists of at least one layer, is formed mainly from craft paper. The synthetic resin film that forms the inner bag element is formed from a thermoplastic resin, and has the property of easy tearing in one axial direction. This axial direction is the width direction that is perpendicular to the longitudinal direction of the inner bag element when the inner bag element is formed.

9 Claims, 3 Drawing Sheets

PAPER BAG WITH FILM INNER BAG

CROSS REFERENCE TO RELATED APPLICATIONS

This application is based upon and claims the benefit of priority from the prior Japanese Patent Application No. 2001-247029 filed on Aug. 16, 2001; the entire contents of this prior application being incorporated herein by reference.

BACKGROUND OF THE INVENTION

1. Field of the Invention

The present invention relates to a paper bag with a film inner bag, and more particularly to a paper bag that comprises an outer bag element made of paper and an inner bag element as an inner-layer bag made of a synthetic resin film, wherein after the paper bag is filled with a content and stored in or conveyed to a destination, the inner bag element can easily be opened by manual operations after being taken out from the outer bag element or without being taken out from the outer bag element.

2. Description of the Related Art

Conventionally, paper bags having a film inner bag element consisting of a film made of a synthetic resin such as a polyethylene or the like as an inner-layer bag have generally been referred to as "paper bags with an inner bag element". Since such bags are suitable in terms of air-tightness, moisture-proof properties and cleanness, these bags have been widely used in large quantities. The conventional paper bags with a film inner bag element are generally configured such that a paper outer bag element consists of two to three layers of craft paper and a film inner bag element consisting of a polyethylene film is provided as the innermost layer of the out bag. The bags have been used for the transportation and storage of foodstuffs such as sugar, various types of powders, cereals, protein, etc., as well as resin pellets or the like (hereafter referred to simply as "contents").

Although the conventional paper bags with a film inner bag element have excellent air-tightness, moisture-proof properties and cleanness and therefore are very convenient to use, there is a problem in that it is not easy to open. To describe more specifically on this point, the inner bag element used in the conventional paper bags has a structure in which one end of a tubular body consisting of a synthetic resin film is left open to form a mouth through which contents are filled, while the other end is closed to form a closed bottom part either by heat-sealing across the entire width, by folding two or more times together with the outer bag element or by stitching with a sewing machine together with the outer bag element.

In such a paper bag with a film inner bag element, after it is filled with a specified amount of contents from the open part at one end of the paper bag, i.e., from the mouth part of the inner bag element, the mouth part is closed by heat sealing across the entire width, and finally, the open part at one end of the outer bag element is closed. Thereafter, the paper bag filled with contents is transported or stored, and later the paper bag is opened when it is necessary to take out the contents.

There are two methods of opening the paper bag. In one former method, one end of the outer bag element is cut together with the end portion of the inner bag element inside the outer bag element using scissors or the like so that the paper bag is opened. In another method, the closed parts at both ends of the outer bag element are opened by being undone and the inner bag element is taken out from the outer bag element, and then an end portion of the inner bag element is opened. The former method has a problem in that since the closed end portions of both the outer bag element and the inner bag element, which are securely closed, are opened by being cut with scissors at the same time, an extreme amount of effort is required in order to open the bag, so that the bag cannot be opened quickly.

In the latter method, both ends of the inner bag element that is taken out from the outer bag element remain closed by heat-sealing or the like. Accordingly, one of the end portions of the inner bag element is cut in lateral direction across the entire width or a portion of the width in a position that is located further toward the center of the bag than the heat-sealed portion with respect to the longitudinal direction, thus forming a discharge opening and the contents are removed from this discharge opening.

To make a lateral cut in one end portion of the inner bag element, a tool with a sharp blade such as a cutter knife, scissors or the like has conventionally been used. Thus, in order to remove the contents from the inner bag element that has been filled with the contents and then closed at both ends by heat-sealing, it has always been necessary to using an opening tool such as a blade or the like, both in the former method and latter method described above. In particular, the reason that it is necessary to use a blade or the like even in the latter method is that the synthetic resin films used to form conventional inner bag elements are of the type having properties that prevent tearing by hand.

As a result, to open an inner bag element of this type, it is always necessary to provide an opening tool such as a blade or the like for ready use, which is extremely bothersome. As a result, the working efficiency of the opening process drops considerably. Moreover, when such an opening tool is used to open the inner bag element, it may occur such problem that the worker may accidentally drop the cutter knife, scissors or the like into the opened inner bag element without noticing that, and the contents are sent into a subsequent processing while the contents still contain the dropped opening tool.

Furthermore, when such an opening tool is used to open the inner bag element, there is a possibility that the problem of contamination may occur. Namely, when the end portion of the inner bag element is cut open across, for example, the entire width with scissors or the like, so called "twice cutting" may easily occur. When the "twice cutting" occurs, small cut pieces of the inner bag element are produced, and these pieces may be admixed with the contents inside the inner bag element during the opening process.

Further, dust may adhere to the opening tools for opening the paper bag, and it may occur that this dust on the opening tools will fall during use and be admixed with the contents in the inner bag element during the opening process.

Accordingly, there has been a demand for a paper bag with a film inner bag element that can easily be opened, either partially or across the entire width of the bag, by tearing the end portion of the inner bag element in the lateral direction by hand without using a special opening tool, either in cases where the inner bag element is opened after being taken out from the outer bag element, or in cases where the inner bag element is opened without being taken out from the outer bag element.

SUMMARY OF THE INVENTION

It is an object of the present invention to provide a paper bag with a film inner bag element which is constructed in order to solve these conventional problems, and which can easily be opened by a manual operation, either partially or across the entire width of the bag, by tearing the end portion of the inner bag element in the lateral direction.

A paper bag with a film inner bag element according to an aspect of the present invention, comprises an outer bag element comprising at least one layer formed mainly from craft paper and having a closed end portion forming a bottom part thereof; and an inner bag element comprising a tubular body formed from a synthetic resin film and having a closed end portion forming a bottom part thereof, the inner bag element being disposed inside the outer bag element, wherein a cut portion used as a tearing guide is formed along the longitudinal direction in an end portion of the inner bag element that is closed by heat-sealing and that is planned to be opened in the future, including the closed end portion on the bottom side, and wherein the synthetic resin film that forms the inner bag element is a thermoplastic resin film having a property of allowing easy tearing in one axial direction, the inner bag element being formed so that the one axial direction is a width direction thereof that is perpendicular to a longitudinal direction thereof.

The paper bag with a film inner bag element according to another aspect of the present invention is characterized in that the paper bag with a film inner bag element is a pleated paper bag which has pleats on both side portions thereof, and wherein the inner bag element has pleated portions in both side portions thereof, and the cut portion is formed with in a position located further toward the center with respect to the width direction than trough-fold positions of the pleated portions when the end portions of the tubular body are placed in a flat state.

The paper bag with a film inner bag element according to still another aspect of the present invention is characterized in that one of a mouth-part closed portion that is closed when the paper bag is closed after the paper bag has been filled with contents and the bottom-part closed portion of the outer bag element, is closed either by stitching with a sewing machine or closed using a covering paper equipped with an opening tape, another of the closed portions is formed so as to constrain the end portion of the inner bag element and never to be opened, and when the contents are to be removed, the outer bag element is opened by tearing the covering paper using the opening tape, or by removing a stitching thread, and then the inner bag element is opened by tearing the heat-sealed end portion of the inner bag element inside the opened outer bag element without taking out the inner bag element from the outer bag element.

The paper bag with a film inner bag element according to further aspect of the present invention is characterized in that both the bottom-part closed part of the outer bag element and a mouth-part closed portion of the outer bag element that is closed when the paper bag is closed after the paper bag has been filled with contents, is closed by folding the end portions of the outer bag element and the end portions of the inner bag element at least one time and by enclosing and fastening these bent portions with covering papers that are equipped with opening tapes, and when the contents are to be removed, both end portions of the outer bag element are opened by tearing the covering papers using the opening tapes, the constraint between the outer bag element and the end portion of the inner bag element is released, the inner bag element is taken out from the outer bag element, and the heat-sealed end portion of the inner bag element is torn so as to open the inner bag element.

The paper bag with a film inner bag element according to still further aspect of the present invention is characterized in that the thermoplastic resin film that forms the inner bag element is made of polyethylene resin or ionomer resin.

Further, the paper bag with a film inner bag element according to an aspect of the present invention is characterized in that the thermoplastic resin film that forms the inner bag element is constituted by a laminated body consisting of a plurality of layers, and at least one of the layers of the laminated body is formed by an ionomer resin layer.

Furthermore, the paper bag with a film inner bag element according to an aspect of the present invention is characterized in that the thermoplastic resin film that forms the inner bag element is a laminated body consisting of three layers in which the ionomer resin layer is disposed as the intermediate layer, and low-density polyethylene resin layers are disposed on both sides of the intermediate layer as the inner layer and outer layer.

Furthermore, the paper bag with a film inner bag element according to an aspect of the present invention is characterized in that the low-density polyethylene resin layers disposed as the inner layer and outer layer are composed of resin film layers in which a low-density polyethylene is blended with a linear low-density polyethylene that is polymerized by a metallocene catalyst in a polyolefin.

Still further, the paper bag with a film inner bag element according to an aspect of the present invention is characterized in that the thermoplastic resin film is at least a stretched film which is stretched only in a direction perpendicular to the one axial direction.

DESCRIPTION OF THE PREFERRED EMBODIMENTS

The paper bag with a film inner bag element according to the present invention will be described in detail in terms of a preferred embodiment in reference to the accompanying drawings.

Figure 1:
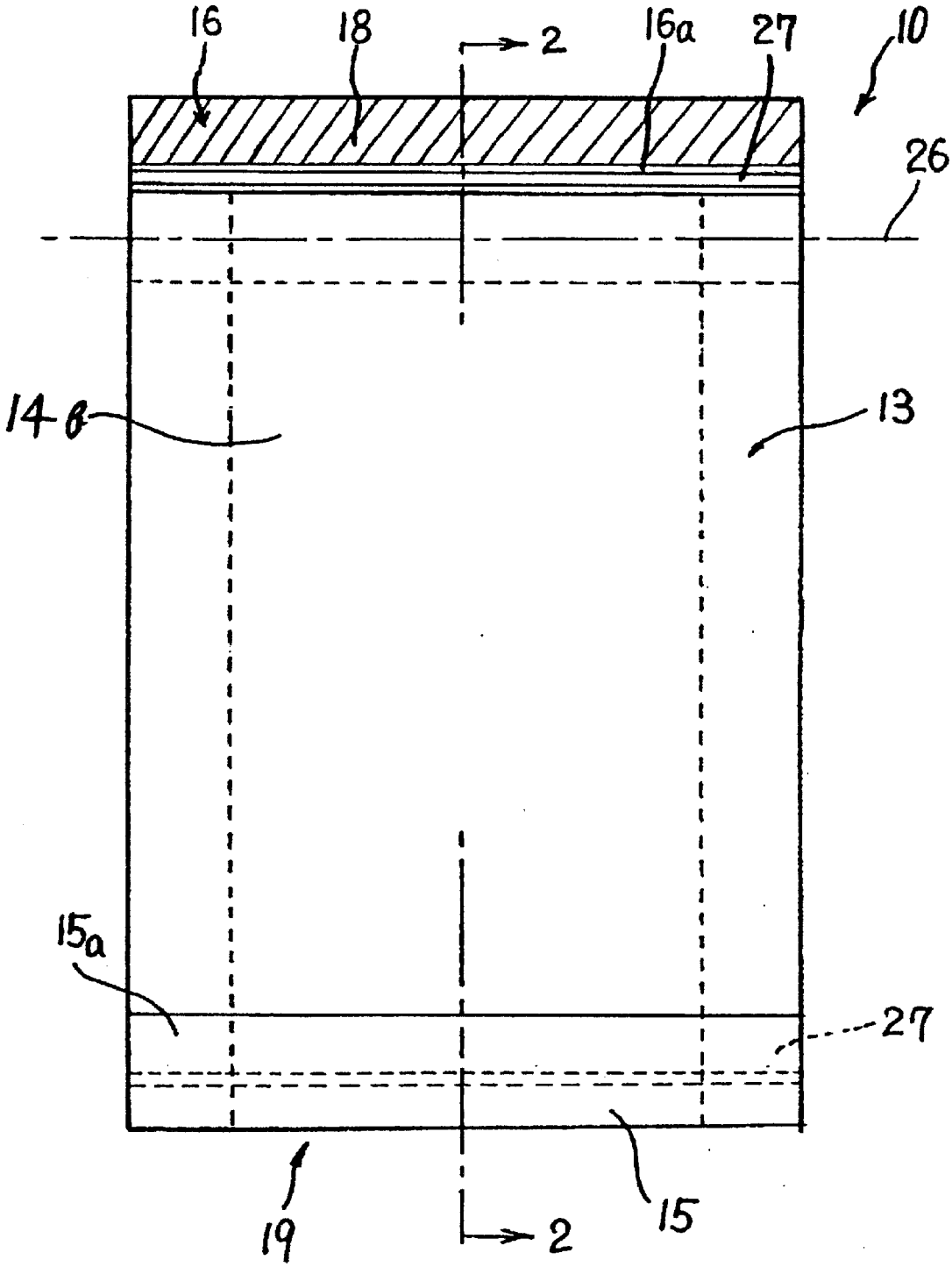
FIG. 1 is a plan view illustrating a paper bag with a film inner bag element according to one embodiment of the present invention in a flat state.
Figure 3:
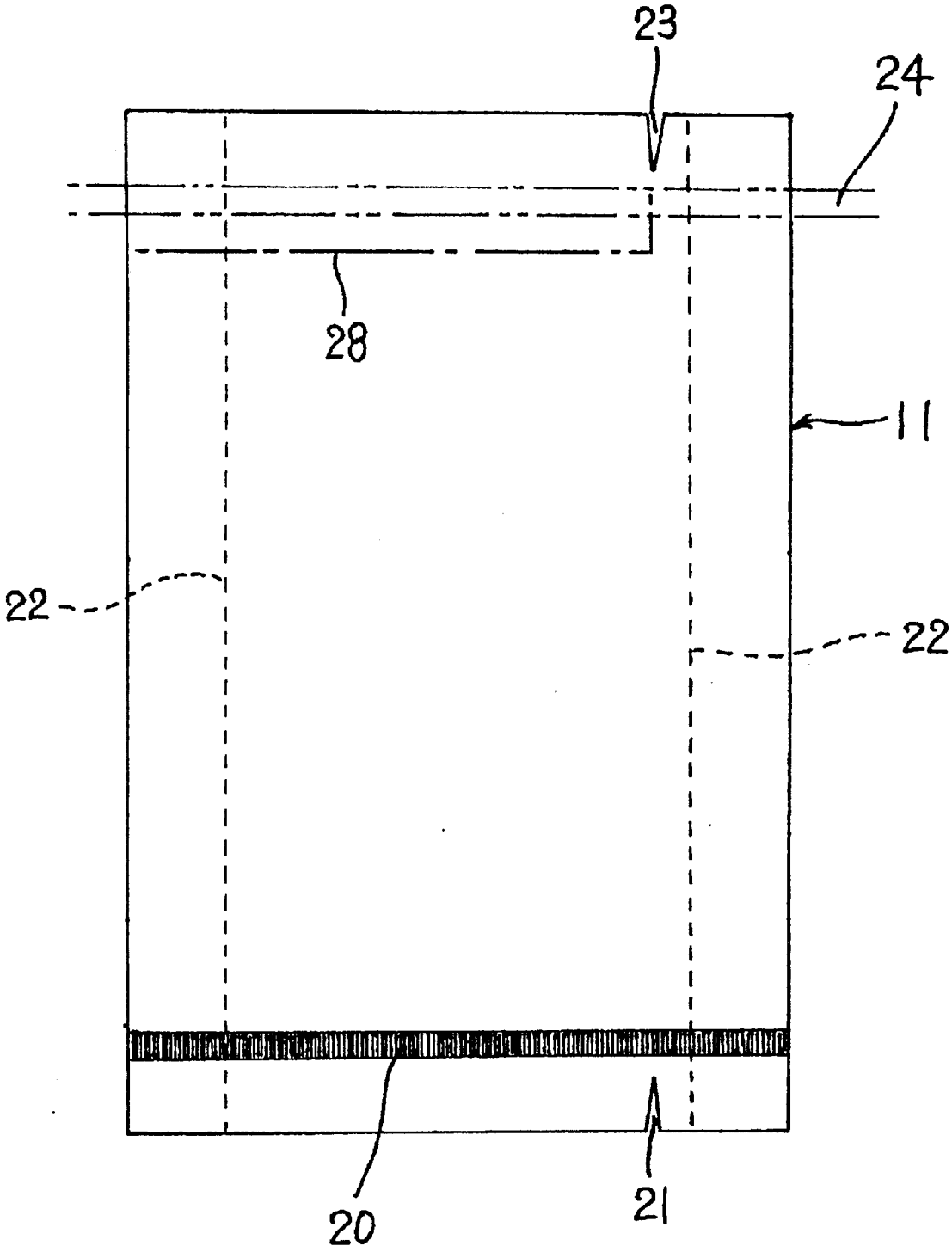
FIG. 3 is a plan view illustrating the inner bag element in a flat state, which is disposed inside the paper shown in FIG. 1.

Referring to FIGS. 1 and 3, a paper bag 10 with an inner bag element according to one embodiment of the present invention comprises an inner bag element 11 made of a synthetic resin film, and a two-layer outer bag element 12 inside which the inner bag element 11 is disposed as an inner-layer bag. The paper bag 10 of the present embodiment is a pleated paper bag, which has pleats on both side portions of the outer bag element. Pleated portions are also formed on both side portions of the inner bag element 11.

The outer bag element 12 is constructed using a tubular body 13 as the basic constituent element formed generally from craft paper in two layers. Both ends of the tubular body 13 are cut rectilinearly, and both the side portions are formed with pleats. As is shown in FIGS. 1 and 2, paper pieces 15 and 16 which having a width same as the width of the wall surfaces of the tubular body 13 are secured by means of an adhesive agent 17 to one wall surface 14*a* in each end portion of the tubular body 13.

More specifically, one end of each of the paper pieces 15 and 16 is pasted to the corresponding end-portion wall surface 14*a* of the tubular body 13 so that the other end is caused to protrude outward in the longitudinal direction from the end edge of the pleated tubular body 13. This paper bag 10 is formed from the tubular body 13 and the inner bag element 11 by disposing the inner bag element 11 whose bottom part is heat-sealed inside the tubular body 13.

Figure 2:
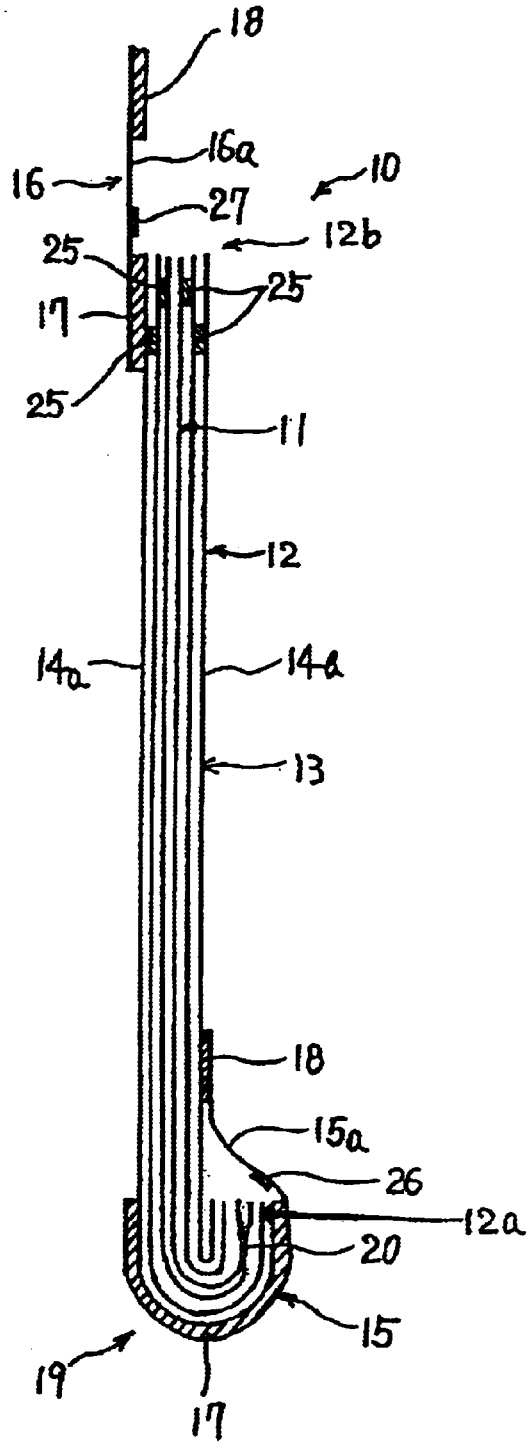
FIG. 2 is a sectional view schematically illustrating the sectional structure along line 2—2 of the inner bag element shown in FIG. 1.

When disposing the inner bag element 11 inside the outer bag element 12, it is desirable that the inside surfaces of the wall surfaces 14*a* and 14*b* of the outer bag element 12 and the inner bag element 11 be lightly bonded to each other in spots using an adhesive agent 25 in the end portion on the side of the mouth part of the bag, as shown in FIG. 2. This makes it easy to open the mouth part of the paper bag 10 when the bag is filled with contents.

Afterward, as is shown in FIG. 1, the paper piece 15 is folded together with the end portion of the tubular body 13 and the closed end portion of the inner bag element 11 disposed inside the tubular body 13, and is bonded to the other facing wall surface 14*b* by means of an adhesive agent 18 that is applied to the surface of the other end of the paper piece 15. Thus, a bottom-part closed portion 19 of the outer bag element 12 is formed.

To close the mouth part of the paper bag 10 having constructed as described above when it has been filled with contents, the mouth part is sealed using the other paper piece 16 by the same manner as that used to form the bottom-part closed portion 19. As is clear from the above description, these paper pieces 15 and 16 are provided so that the parts that protrude from the end edges of the pleated tubular body 13 serve both as closing flaps and as covering papers. Therefore, these parts of the respective paper pieces 15 and 16 that protrude from the end edges of the pleated tubular body 13 will hereafter be referred to as "flap-and-covering paper". The flap-and-covering papers are indicated by the symbols 15*a* and 16*a*.

The inner bag element 11 is formed from a synthetic resin film as mentioned above. A thermoplastic resin film is desirable as the synthetic resin film that forms the inner bag element 11. Further, a polyethylene resin is desirable as the thermoplastic resin film forming the inner bag element 11. The inner bag element 11 is formed from a tubular body with a specified length that is formed, for example, by an inflation molding method. The tubular body that is used to form the inner bag element 11 is referred to as the "inner bag element formation tubular body".

However, this inner bag element formation tubular body is not limited to being formed by the inflation molding method. It may also be formed into a tubular shape by overlapping both side portions of a single sheet of thermoplastic film with each other and bonding them. As shown in FIG. 3, the inner bag element 11 is formed by closing one end of the inner bag element formation tubular body by heat-sealing across the entire width of the tubular body. The end portion in which this heat-sealed part 20 is formed is disposed inside the outer bag element 12 as the closed bottom part of the inner bag element 11.

As shown in FIG. 3, a cut portion 21 which is used as a tearing guide is formed in the end edge of the closed bottom part of the inner bag element 11. The cut portion 21 is formed in a position which is located further toward the center with respect to the width direction than the position of the trough-fold (trough-fold line indicated by the symbol 22 in FIG. 3) of one of the pleated portions when the end portion of the inner bag element formation tubular body is placed in a flat state. The cut depth of this cut portion 21 is such that the cut portion 21 extends up to or just shortly before the heat-sealed part 20.

The reason for this cut depth is as follows: if the cut portion 21 extends further toward the center in the longitudinal direction of the inner bag element 11 passing through the heat-sealed part 20, the cut portion 21 will naturally communicate with the interior of the inner bag element 11 so that leakage of the contents will occur. Further, another cut portion 23 used as a tearing guide is also formed in the end edge of the mouth end part on the opposite end of the inner bag element 11 from the closed bottom part.

The mouth end part of the inner bag element 11 is left open until the bag has been filled with the contents. After the inner bag element 11 has been filled with the contents, the bag is heat-sealed across the entire width so that the mouth end part is closed. A planned heat-seal band region 24 where heat-sealing of the mouth end part of the inner bag element 11 is planned is in a position that is located further toward the center in the longitudinal direction of the inner bag element 11 than the length, i.e., depth, of the cut portion 23. The reason for this is the same as the reason for the relationship between the heat-sealed part 20 and cut portion 21 formed in the closed bottom part.

In the inner bag element 11 shown in FIG. 3, the cut portions 21 and 23 are formed in both end portions as described above. However, this is done only to allow opening from either end portion of the bag when the inner bag element 11 is opened. It is sufficient if a cut portion is formed in at least one end portion of the inner bag element 11. Furthermore, the cut portions 21 and 23 are formed as V-shaped cut portions. However, the shape of the cut portions is not limited to this shape. For example, simple linear cut portions, i.e., slit lines, may also be used.

Next, the method of use of the paper bag 10 with an inner bag element according to the present embodiment will be described. Having filled the inner bag element 11 with contents such as synthetic resin pellets or the like from the mouth part of the paper bag 10 with the inner bag element, the mouth part of the paper bag 10 is flattened, and the planned heat-seal band region 24 in which heat-sealing is planned is heated by a pair of heating bars, so that the mouth part of the inner bag element 11 is heat-sealed.

Subsequently, the flattened mouth end portion of the paper bag is folded together with the mouth end portion of the inner bag element 11 along a planned folding line 26 while the hot-melt type adhesive agent 18 coated on the flap-and-covering paper 16*a* is reactivated by heating, so that the flap-and-covering paper 16*a* is bonded to the opposite wall surface 14*b* of the outer bag element 12 by the adhesive agent 18, thus closing the mouth part.

The paper bag 10 whose mouth part has thus been closed, is then conveyed to the site where the contents are to be used. In the paper bag 10, an opening tape 27 is attached to the inside surface of the flap-and-covering paper 16*a* on the closed portion of the mouth part or to the inside surface of the flap-and-covering paper 15*a* on the bottom-part closed portion 19, or to the inside surfaces of both of these flap-and-covering papers 15*a* and 16*a* (more accurately, this opening tape 27 is attached to the area between the adhesive agent 18 and the end edge of the outer bag element 12 that is not coated with any adhesive agent). To open the outer bag element, the end portion of the opening tape 27 is grasped by hand and lifted, so that the flap-and-covering paper 15*a* or 16*a*, or both flap-and-covering papers 15*a* and 16*a*, are torn.

In that manner, the mouth part and bottom part of the outer bag element 12 are opened. Then, the inner bag element 11 is taken out from the opened end portion. The inner bag element 11 taken out in this manner is carried into a place such as clean room, where it is opened, where the contents are removed from the interior of the inner bag element 11 and placed in an appropriate container. To open the inner bag element 11, the inner bag element 11 is forcibly torn by hand in the longitudinal direction from the cut portion 21 or 23 formed in the end edges of the inner bag element 11.

When this tear progresses beyond the heat-sealed portion, the direction of the tearing is altered to the lateral direction, i.e., in the width direction, of the inner bag element 11. As a result, one end of the inner bag element 11 is opened roughly in an L shape as indicated by the imaginary line 28 in FIG. 3. Since the tearing length is long in tearing in the lateral direction of the inner bag element 11, the thermoplastic resin film that forms the inner bag element 11 is endowed with the property of easy tearing in the lateral direction so that this lateral tearing can easily be accomplished by hand.

Polyethylene films (e.g., low-density polyethylenes (LDPE), linear-chain low-density polyethylene (LLDPE) and the like) conventionally used in inner bag elements are very strong and extremely difficult to tear. However, it is known that if an appropriate molecular orientation is applied during the molding of the film, there are cases in which directionality is created in the tearing characteristics, and if the film is worked by means of casting film-molding machines or inflation film-molding machines, the film becomes easy to tear in the take-up direction (MD direction).

In the present invention, in order to obtain a film that has easy tearing characteristics in the direction (TD direction) perpendicular to the take-up direction (MD direction), the thermoplastic resin film that forms the inner bag element 11 is formed as a laminated film that consists of two or more layers, and an ionomer resin film is included in at least one of these layers.

As a result of the inclusion of the ionomer resin layer, the film of the present invention exhibits easy tearing characteristics in the direction (TD direction) that is perpendicular to the take-up direction (MD direction), unlike conventional synthetic resin films.

As conventional techniques relating to this, Japanese Patent Application Laid-Open No. 2000-202956 discloses a laminated film with easy tearing characteristics in the lateral direction, and Japanese Patent Application Laid-Open No. 2000-289151 discloses an easy-tearing stretched laminated film and method of manufacturing the same.

Accordingly, when the inner bag element 11 is formed using a multi-layer thermoplastic resin film that has an ionomer resin layer, if the film is formed so that the take-up direction (MD direction) of the thermoplastic resin film is the longitudinal direction of the inner bag element, then the width direction of the inner bag element 11 becomes the TD direction of the thermoplastic resin film. As a result, an easy-lateral-tearing inner bag element can be formed.

Specifically, it is desirable that the thermoplastic resin film that forms the easy-lateral-tearing inner bag element 11 be constructed from a laminated body in which three layers comprising an inner layer, an intermediate layer and an outer layer, are laminated. In the three layers, it is desirable that the inner layer and outer layer be constructed from resin films consisting of a low-density polyethylene (hereafter referred to as "LDPE") or resin films consisting of a linear-chain low-density polyethylene (hereafter referred to as "LLDPE") polymerized in a polyolefin using a metallocene catalyst or the like, and that the intermediate layer be constructed from a resin film consisting of an ionomer.

Alternatively, it is also possible to construct the inner layer and outer layer from resin films consisting of a blend of an LLDPE and LDPE, and to construct the intermediate layer from a resin film of ionomer. Generally, LLDPE has a high lateral tearing strength, while LDPE tends to be weak in lateral tearing strength. Accordingly, an intermediate strength can be obtained by blending both types of resins.

Furthermore, LLDPE obtained using a metallocene catalyst has a high strength, and therefore impedes easy tearing even if an ionomer resin is disposed in the intermediate layer. Accordingly, measures may be taken in which the LLDPE layers are made thin. If such measures are taken, however, the impact strength and rigidity are reduced so that there are limits to how far these layers can be made thin, and the lateral tearing characteristics can be finely adjusted by blending a small amount of LDPE.

As described above, a thermoplastic resin film which is formed from a laminated body in which a resin film consisting of an ionomer is sandwiched between resin films consisting of LLDPE or LDPE, or films consisting of a blend of LLDPE and LDPE, exhibits easy tearing characteristics in the TD direction, i.e., in the lateral direction. If uniaxial stretching is performed in the MD direction during the formation of this thermoplastic resin film, the easy tearing characteristics in the lateral direction can be further improved conspicuously.

In an ordinary thermoplastic resin film, if stretching is secondarily applied to a produced film, tearing tends to occur along the direction of stretching. However, the thermoplastic resin film described above, which forms the inner bag element of the present invention, has the special feature of easy tearing in the direction perpendicular to the direction of stretching. Accordingly, when it is desired to enhance the tearing characteristics in the TD direction (easy tearing in the lateral direction), the desired laminated film can be produced by stretching in the longitudinal direction (MD direction) in in-line processes. Incidentally, if stretching is performed simultaneously in two axial directions, the blank (initial) easy lateral tearing characteristics are maintained, and the tearing strength in the TD direction drops. Tearing in the MD direction is difficult, and this tearing turns into the TD direction.

Next, examples of the inner bag element used in the paper bag with a film inner bag element according to the present invention will be described. Please note, however, the present invention is not limited to the following examples. There can be another examples of the present invention, as long as there is no departure from the gist of the present invention,

EXAMPLE 1

The thermoplastic resin film that forms the inner bag element used in the paper bag according to the present invention was formed by three-layer inflation molding in which a three-layer film consisting of an inner layer, intermediate layer and outer layer was laminated by means of a three-layer extruder. The inner-layer film and outer-layer film were formed from an LLDPE resin (trade name "EVOLUE SP2520", manufactured by Mitsui Chemicals, Inc.), and the intermediate-layer film was formed from an ionomer resin (trade name "HIMLAN 1601", manufactured by Dupont-Mitsui Polychemicals Co., Ltd.). The thickness of the film was 80 $\mu$m, and the thickness ratio of the respective layers (inner layer:intermediate layer: outer layer) was 2.5:5:2.5.

EXAMPLE 2

The thermoplastic resin film that forms the inner bag element used in the paper bag according to the present invention was formed by three-layer inflation molding in which a three-layer film consisting of an inner layer, intermediate layer and outer layer was laminated by means of a three-layer extruder. The inner-layer film and outer-layer film were formed from a thermoplastic resin in which an LLDPE resin (trade name "EVOLUE SP2520", manufactured by Mitsui Chemicals, Inc.) and an LDPE resin (trade name "MIRASON 401", manufactured by Mitsui Chemicals, Inc.) were blended at the respective rates of 70% and 30%, and the intermediate-layer film was formed from an ionomer resin (trade name "HIMLAN 1601", manufactured by Dupont-Mitsui Polychemicals Co., Ltd.). The thickness of the film was 80 $\mu$m, and the thickness ratio of the respective layers (inner layer:intermediate layer:outer layer) was 2.5:5:2.5.

EXAMPLE 3

The thermoplastic resin film that forms the inner bag element used in the paper bag according to the present invention was formed by three-layer inflation molding in which a three-layer film consisting of an inner layer, intermediate layer and outer layer was laminated by means of a three-layer extruder. The inner-layer film and outer-layer film were formed from a thermoplastic resin in which an LLDPE resin (trade name "EVOLUE SP2520", manufactured by Mitsui Chemicals, Inc.) and an LDPE resin (trade name "MIRASON 401", manufactured by Mitsui Chemicals, Inc.) were blended at the respective rates of 70% and 30%, and the intermediate-layer film was formed from an ionomer resin (trade name "HIMLAN 1601", manufactured by Dupont-Mitsui Polychemicals Co., Ltd.). The thickness of the film was 80 $\mu$m, and the thickness ratio of the respective layers (inner layer:intermediate layer:outer layer) was 3:4:3.

The thermoplastic resin films obtained in the Examples 1 through 3 were endowed with easy tearing characteristics in the TD direction. Accordingly, the inner bag element in each case was formed from the thermoplastic resin film so that the easy-tearing TD direction coincided with the width direction of the inner bag element. To open the inner bag element, the inner bag element was torn by hand from the cut portion at one end of the inner bag element to a point beyond the heat-sealed part and then the tearing direction was altered to the lateral direction, so that the end portion of the inner bag element was torn in an L shape.

As a result, it turned out that although tearing to a point beyond the heat-sealed part in the longitudinal direction from the cut portion at one end of the inner bag element was somewhat difficult, tearing was accomplished very easily and in a straight line even by hand after the tearing was shifted to the lateral direction from a point beyond the heat-sealed part.

The tearing easiness of the thermoplastic resin films obtained in the Examples 1 through 3 were compared and the results of a comparison were as follows:

[Easy]←Example 2>Example 1>Example 3→[Difficult]

It is seen from the comparison results that tearing becomes easier as the thickness ratio of the ionomer resin increases. Further, easy lateral tearing characteristics appeared manifested when the thickness of the ionomer resin was 40% of the overall thickness of the film or greater. Furthermore, although the thickness of the ionomer resin was the same in the Examples 1 and 2, Example 2 was superior in terms of easy lateral tearing characteristics than Example 1. This is because in Example 2, LDPE resin was blended with the LLDPE resin.

COMPARATIVE EXAMPLE

The thermoplastic resin film forming the inner bag element was formed by three-layer inflation molding in which a three-layer film consisting of an inner layer, intermediate layer and outer layer was laminated by means of a three-layer extruder. The inner-layer film and outer-layer film were formed from a thermoplastic resin consisting of 100% LLDPE (trade name "EVOLUE SP2520", manufactured by Mitsui Chemicals, Inc.), and the intermediate-layer film was formed from an ionomer resin (trade name "HIMLAN 1601", manufactured by Dupont-Mitsui Polychemicals Co., Ltd.).

The thickness ratio (inner layer:intermediate layer:outer layer) was 3.5:3:3.5, and the thickness of the film was 80 $\mu$m.

A inner bag element was formed using this thermoplastic resin film so that the TD direction of the film coincided with the width direction of the inner bag element. Afterward, this inner bag element was torn by hand in the longitudinal direction from a cut portion formed at one end of the inner bag element to a point beyond the heat-sealed part. Then, an attempt was made to shift the tearing direction to the lateral direction, and to tear the end portion of the inner bag element in an L shape. However, although it managed to tear the bag in the short distance from the cut portion to a point beyond the heat-sealed part in the longitudinal direction, it was almost impossible to tear the bag after the tearing direction was altered to the lateral direction.

In fact, when the tearing was attempted after the tearing direction was altered to the lateral direction by forcibly applying a larger force, the tearing direction was extremely unstable, showing shift to undesirable directions, such as shift to the longitudinal direction. Therefore, it turned out that this inner bag element was impractical to use.

In the paper bag with a film inner bag element according to the embodiment described above, a two-layer outer bag element 12 is so constructed that paper pieces provided with opening tapes are bonded to the wall surfaces at both ends of a pleated tubular body in which both end portions are cut rectilinearly, thus forming flap-and-covering paper. To open the paper bag, the flap-and-covering papers closing both ends of the outer bag element 12 are torn using the opening tapes, and the inner bag element 11 is removed from the outer bag element 12. Then, the inner bag element 11 is opened by tearing the end portion of the inner bag element 11. However, the present invention is not limited to such a structure of this embodiment.

In another example of the construction of the paper bag with a film inner bag element according to the present invention, the flap-and-covering papers is not bonded to the tubular body beforehand. To close the end portions of the outer bag element, the end portions of the outer bag element and the end portions of the inner bag element are folded together at least one time, and the closing is accomplished by enclosing and fastening these folded parts with covering papers equipped with opening tapes. In still another example of the construction, the closing may be accomplished by conventional stitching by using a sewing machine.

However, in the paper bag with a film inner bag element according to the present invention, it is necessary that at least one of the two ends, that is, the bottom part and the mouth part is closed by using a covering paper equipped with an opening tape or the like, or by stitching with a sewing machine. In other words, it is necessary at least one of the bottom part and the mouth part of the outer bag element can easily be opened by hand without using a blade or the like opening tools.

In the paper bag where means that allow easy opening is provided in only one of the bottom end portion and the mouth end portion of the outer bag element and the other one which is not provided such means has a conventional closed structure that cannot easily be opened, even if the end portion that has means that allows easy opening is opened so that this end portion of the outer bag element is opened, the inner bag element cannot be taken out from the outer bag element. This is because of the fact that in a normal end-portion closed structure where means that allow easy opening is not provided, the closed end portion of the inner bag element is formed in such a manner that this portion is constrained by the end portion of the outer bag element.

When the contents are to be removed from the paper bag with such a structure, the easy-opening end portion of the outer bag element is opened by tearing the covering paper using the opening tape or by removing the stitching thread, and then, without taking out the inner bag element from the outer bag element, a hand is inserted into the opened aperture of the outer bag element, and the inner bag element is opened by tearing the end portion of the inner bag element by hand inside the outer bag element. Since it is so constructed that the inner bag element can easily be torn in the lateral direction by hand, the inner bag element can be opened very easily and quickly without any need for a great deal of force and, furthermore, without almost any concern about contamination of the contents.

In the paper bags with an inner bag element according to the embodiment, the bottom part of the inner bag element is closed by heat-sealing. However, the present invention is not limited to an inner bag element of such a construction as in the embodiment. There may be other constructions. For example, the paper bag according to the present invention may be so constructed that when the closed bottom portion of the outer bag element is formed by applying a sewing machine as described above, the sewing machine may also be applied to the bottom part of the tubular body constituting the inner bag element so as to form the closed bottom part of the inner bag element at the same time. Alternatively, the closed bottom portion of the paper bag may be formed by folding the bottom part of the tubular body that constitutes the inner bag element together with bottom part of the outer bag element two or more times after the tubular body is inserted into the outer bag element.

In the paper bag with a film inner bag element according to the present invention, as is described above, the inner bag element is formed from a thermoplastic resin film that has the property of easy tearing in the direction of one axis, and the inner bag element is arranged so that the direction of this easy-tearing axis is the width direction that is perpendicular to the longitudinal direction of the inner bag element when the inner bag element is formed. Accordingly, when the inner bag element is to be opened, this bag can be easily and cleanly torn by hand in a straight line in the width direction without using any special opening tool such as a blade or the like. Consequently, the opening work is extremely efficient, and the fear of contamination is completely eliminated.

The present invention can also be embodied in various other aspects without departing from the spirit or principal characterizing features of the invention. Accordingly, the embodiments described above are mere examples in all respects, and are not to be interpreted in a limiting manner. The scope of the present invention is the scope that is indicated by the claims, and is not constrained in any way by the main text of the specification. Furthermore, all modifications and alterations within a range that is equivalent to the scope of the claims are included in the scope of the present invention.

What is claimed is:

1. A paper bag with a film inner bag element, comprising:

an outer bag element comprising at least one layer formed mainly from craft paper and having a closed end portion forming a bottom part thereof; and an inner bag element comprising a tubular body formed from a synthetic resin film and having a closed end portion forming a bottom part thereof, the inner bag element being disposed inside the outer bag element, wherein a cut portion used as a tearing guide is formed along the longitudinal direction in an end portion of the inner bag element that is closed by heat-sealing and that is planned to be opened in the future, including the closed end portion on the bottom side, and wherein the synthetic resin film that forms the inner bag element is a thermoplastic resin film having a property of allowing easy tearing in one axial direction, the inner bag element being formed so that the one axial direction is a width direction thereof that is perpendicular to a longitudinal direction thereof.

2. The paper bag with a film inner bag element according to claim 1, wherein the paper bag with a film inner bag element is a pleated paper bag which has pleats on both side portions thereof, and wherein the inner bag element has pleated portions in both side portions thereof, and the cut portion is formed with in a position located further toward the center with respect to the width direction than trough-fold positions of the pleated portions when the end portions of the tubular body are placed in a flat state.

3. The paper bag with a film inner bag element according to claim 2, wherein one of a mouth-part closed portion that is closed when the paper bag is closed after the paper bag has been filled with contents and the bottom-part closed portion of the outer bag element, is closed either by stitching with a sewing machine or closed using a covering paper equipped with an opening tape, another of the closed portions is formed so as to constrain the end portion of the inner bag element and never to be opened, and when the contents are to be removed, the outer bag element is opened by tearing the covering paper using the opening tape, or by removing a stitching thread, and then the inner bag element is opened by tearing the heat-sealed end portion of the inner bag element inside the opened outer bag element without taking out the inner bag element from the outer bag element.

4. The paper bag with a film inner bag element according to claim 2, wherein both the bottom-part closed part of the outer bag element and a mouth-part closed portion of the outer bag element that is closed when the paper bag is closed after the paper bag has been filled with contents, is closed by folding the end portions of the outer bag element and the end portions of the inner bag element at least one time and by enclosing and fastening these bent portions with covering papers that are equipped with opening tapes, and when the contents are to be removed, both end portions of the outer bag element are opened by tearing the covering papers using the opening tapes, the constraint between the outer bag element and the end portion of the inner bag element is released, the inner bag element is taken out from the outer bag element, and the heat-sealed end portion of the inner bag element is torn so as to open the inner bag element.

5. The paper bag with a film inner bag element according to claim 1, wherein the thermoplastic resin film that forms the inner bag element is made of polyethylene resin or ionomer resin.

6. The paper bag with a film inner bag element according to claim 5, wherein the thermoplastic resin film that forms the inner bag element is constituted by a laminated body consisting of a plurality of layers, and at least one of the layers of the laminated body is formed by an ionomer resin layer.

7. The paper bag with a film inner bag element according to claim 6, wherein the thermoplastic resin film that forms the inner bag element is a laminated body consisting of three layers in which the ionomer resin layer is disposed as the intermediate layer, and low-density polyethylene resin layers are disposed on both sides of the intermediate layer as the inner layer and outer layer.

8. The paper bag with a film inner bag element according to claim 7, wherein the low-density polyethylene resin layers disposed as the inner layer and outer layer are composed of resin film layers in which a low-density polyethylene is blended with a linear low-density polyethylene that is polymerized by a metallocene catalyst in a polyolefin.

9. The paper bag with a film inner bag element according to claim 1, wherein the thermoplastic resin film is at least a stretched film which is stretched only in a direction perpendicular to the one axial direction.

* * * * *